US007586029B2

(12) United States Patent
Peavey et al.

(10) Patent No.: US 7,586,029 B2
(45) Date of Patent: Sep. 8, 2009

(54) GUITAR AND STRAP FOR PLAYING IN A STANDING CONFIGURATION

(75) Inventors: Hartley D Peavey, Meridian, MS (US); Frederick Joseph Poole, Meridian, MS (US); Paul Joseph Kitterman, Toomsuba, MS (US)

(73) Assignee: Peavey Electronics Corporation, Meridian, MS (US)

( * ) Notice: Subject to any disclaimer, the term of this patent is extended or adjusted under 35 U.S.C. 154(b) by 0 days.

(21) Appl. No.: 11/972,282

(22) Filed: Jan. 10, 2008

(65) Prior Publication Data

US 2009/0178535 A1 Jul. 16, 2009

(51) Int. Cl.
*G10D 1/08* (2006.01)

(52) U.S. Cl. ..... 84/267; 84/291

(58) Field of Classification Search ..... 84/267, 84/291

See application file for complete search history.

(56) References Cited

U.S. PATENT DOCUMENTS

| | | | | | |
|---|---|---|---|---|---|
| 518,775 | A * | 4/1894 | Birrer | 84/267 |
| 860,137 | A * | 7/1907 | Inskeep | 84/294 |
| D45,566 | S * | 4/1914 | Longobardi | D17/14 |
| 1,834,804 | A * | 12/1931 | Puoina | 84/267 |
| 2,519,824 | A * | 8/1950 | Cousineau | 84/312 R |
| 3,788,183 | A * | 1/1974 | Mariner | 84/291 |
| 4,192,213 | A * | 3/1980 | Steinberger | 84/293 |
| 4,483,233 | A * | 11/1984 | Benson | 84/263 |
| 4,915,004 | A * | 4/1990 | Clough | 84/291 |
| D311,413 | S * | 10/1990 | Pakis | D17/20 |
| 5,212,329 | A * | 5/1993 | Woodworth | 84/263 |
| 5,321,201 | A * | 6/1994 | Noreen | 84/735 |
| 5,347,904 | A * | 9/1994 | Lawrence | 84/291 |
| 6,034,308 | A * | 3/2000 | Little | 84/291 |
| 6,703,546 | B1 * | 3/2004 | Wilson | 84/291 |
| 6,992,243 | B2 * | 1/2006 | Small | 84/267 |
| 7,211,719 | B2 * | 5/2007 | Blake | 84/290 |
| 7,256,343 | B2 * | 8/2007 | Brubaker et al. | 84/743 |
| 7,420,107 | B2 * | 9/2008 | Parker et al. | 84/267 |
| 2002/0104424 | A1 * | 8/2002 | Spalt | 84/291 |

* cited by examiner

*Primary Examiner*—Jeffrey Donels
*Assistant Examiner*—Robert W Horn
(74) *Attorney, Agent, or Firm*—Matthew B. Dernier, Esq.; Gibson & Dernier LLP

(57) ABSTRACT

A guitar and strap address the shortcomings of convention guitar design and strap design such that the guitar may be suspended from the strap with a front plane of the guitar oriented generally horizontally, and with the higher frets of the guitar easily accessed by the player's fret-hand.

23 Claims, 5 Drawing Sheets

GUITAR AND STRAP FOR PLAYING IN A STANDING CONFIGURATION

BACKGROUND OF THE INVENTION

The present invention relates to a guitar and related apparatus for permitting a player to suspend the guitar from his or her shoulders in a horizontal orientation or a vertical orientation.

It is again becoming popular to play lap steel guitars, which are played using a bar (or steel) to engage the strings of the guitar instead of pressing down on the string to engage the frets of the guitar. A popular variant of lap steel guitar is slide guitar, where a tube (a slide) is slipped over a finger and used instead of the solid bar to engage the strings. The lap steel guitar was developed in Hawaii in the late 1800s and various people have been credited with the innovation. The instrument was hugely popular in the United States during the 1920s and 1930s. The popularity of lap steel guitar remained strong enough to sustain manufacturers in the U.S. through the middle 1950's.

FIG. 1A is an illustration of a Chandler electric lap steel guitar having a solid body and a Weissenborn profile. One of the distinguishing features of a lap steel guitar is that the strings are raised at both the nut and bridge ends of the fingerboard, typically to about half an inch. This makes the frets unusable in the usual way of playing a conventional guitar. Other lap steel guitars are designed to be adapted between lap and conventional playing, or are modified versions of conventional guitars, with the differences usually being the action height. Guitars designed for lap playing typically have modified necks that make conventional playing impossible. The electric lap steel guitar typically incorporates the entire neck into the solid body of the guitar, providing extra strength to allow a greater variety of string gauges and tunings. The neck is of a square cross section and very thick, which also gives the neck extra strength.

Lap steel guitars are designed to be played horizontally, typically placed on the player's lap, or on a stool or platform in front of the player, who is seated. Thus, one rarely if ever sees strap mounting hardware on a lap steel guitar. (Contrast this to the slide guitar, which is played vertically using a conventional two-point strap.) It is difficult if not impossible to play a lap steel instrument standing up using a conventional strap. Indeed, the lap steel guitar is a solid body instrument of only about two inches thickness. Thus, when a lap steel guitar is suspended from a conventional two-point strap, there is very little thickness to provide stability to maintain the horizontal orientation. If suspended from a two-point strap, the lack of body thickness of the lap steel guitar would tend to result in rotation back to the vertical position.

In 1928 the Dopyera Brothers introduced a new type of acoustic slide guitar in which they placed a metal resonator in the middle of the soundboard. These slide guitars were very successful, so much so that they are still known today as a "DoBro" (a contraction of Dopyera and Brothers). The DoBro has become a generic term for guitars having a metal resonator on the soundboard. The DoBro guitars are slide guitars played in the horizontal position (i.e., not played with the face of the guitar in the vertical position but, rather, in the horizontal position), and are played in a standing position. Playing standing up permits the full output from the acoustic instrument because the backside of the guitar is free to resonate (as opposed to being pressed against the player's body or lap). The DoBro is played using a solid steel (as opposed to a tube) to adjust the effective string length.

One of the major problems with DoBro guitars is the fact that they are somewhat difficult to keep stable in the horizontal position because they are always slung from a strap around the player's neck and/or shoulders with a conventional two-point strap. The thicker acoustic body of the DoBro provides more stability than the solid-body lap steel guitar (discussed above) when slung from the two-point strap. (The DoBro, being an acoustic instrument, includes a fairly thick body—approximately four to five inches thick.) However, stability of the DoBro is still a problem and, thus, players tend to stabilize the guitar with the underside of their right forearm (if they are right-handed players), or with the heel of their right hand. This is a significant limitation to playing the DoBro, as the player's hand is not as free to move as it might otherwise be.

Another problem with suspending the DoBro guitar from a conventional two-point strap relates to the shape of the body. Since the DoBro is an acoustic instrument, and is an adaptation of conventional acoustic guitars, it has a very similar shape to regular acoustic guitars, usually manifesting the traditional figure-8 shape with a rounded, butt-end. This body shape is problematic in presenting the playing surface (fret board) to the left of center of the player's body (for a right handed player). Indeed, the DoBro tends to center itself on the two-point strap, which does not place the fret board to a left-of-center position (for a right-handed player). Instead the fret board is positioned too far to the right (for right handed players) such that the players fret-hand (the hand that moves the bar or slide—often the left hand of right-handed players) cannot easily access the higher frets of the guitar. The fret board of the guitar aligns too far opposite to the fret-hand, which requires the player to reach across his or her body at a drastic angle to access the higher frets.

Another problem with both the DoBro guitar and the lap steel guitar is that they have really no practical ability to be played hanging vertically on a two-point strap. This is so for two reasons: first, the action of the strings is usually set very high; and second, the DoBro and lap steel guitars have a very thick, square neck (for example as seen FIG. 1B). Thus, if a DoBro or lap steel guitar were suspended vertically from a conventional strap, the player would not be able to comfortably work the strings with a slide or his fingers.

The lap steel guitar and the DoBro guitar are associated most closely with Hawaiian music, country music and bluegrass, though some players have used them in rock, jazz, blues, and other musical genres. The round neck, metal-bodied resonator guitar, on the other hand, is used almost exclusively by Blues, Rock, or Blues-Rock musicians.

In short, the convention guitar design, whether lap steel guitars, slide guitars, acoustic guitars, electric guitars, etc., is not easily played standing up in the horizontal orientation. Further, those guitars that are designed for horizontal playing cannot easily be played in the vertical orientation suspended from a conventional strap. The problems associated with playing DoBro guitars standing up have limited the commercial acceptance and use of the instrument.

SUMMARY OF THE INVENTION

In accordance with one or more embodiments of the present invention, a guitar is adapted to be suspended from a strap about a player's shoulder with a front plane of the guitar oriented generally horizontally. The guitar includes a neck; a body coupled to the neck; and a horn extending from the body transversely with respect to the neck to a tip of the horn, the horn including a curvate edge extending from the tip toward a bottom of the body for engaging a fret-hand side of the player. The tip and the curvate edge of the horn are sized and shaped such that the body and neck are offset towards the fret-hand side of the player when suspended, thereby giving the player ready access to higher frets of the neck.

The curvate edge may be sized and shaped to engage the player's midsection starting from the fret-hand side thereof and extending past a center thereof. Alternatively or additionally, the horn is sized and shaped such that the body and neck are offset towards the fret-hand side of the player such that a center of the player is positioned substantially perpendicular to an end of a fret-board of the neck. Further additions and/or alternatives includes that the horn is sized and shaped such that the body is offset towards the fret-hand side of the player such that a center of the player is positioned substantially axially aligned with a horizontal bisecting axis of the body.

Still further additions and/or alternatives includes that the tip of the horn faces in a direction substantially perpendicular to the neck. Still further additions and/or alternatives includes that a center line of the horn, between the leading and curvate edges, is positioned substantially adjacent to frets 6-12 of the neck (such as substantially adjacent to frets 8-10 of the neck). Still further additions and/or alternatives includes that the tip of the horn extends transversely from the body on a first side of the neck a distance from the neck farther than any other portion of the body on the first side of the neck.

In accordance with one or more further embodiments of the present invention, the guitar preferably includes at least three strap buttons disposed about the neck and body; and a strap coupled to the strap buttons such that the guitar is suspended from the strap at three points. A first of the strap buttons is located near an end of the neck opposite the body, and second and third strap buttons are spaced apart from one another at a bottom edge of the body. The strap is operable to extend over a player's shoulder such that a front plane of the guitar is oriented generally horizontally when the player is standing.

The strap includes a central section disposed to engage the player's shoulder or shoulders; a first end coupled from the central section to a first of the three strap buttons located on the neck; and a second end coupled from the central section to second and third strap buttons located on the body. The second end of the strap includes first and second legs extending from an origin and terminating at the second and third strap buttons, respectively. The second and third strap buttons are spaced apart from one another at a bottom edge of the body such that the first and second legs cooperate to maintain an orientation of a front plane of the guitar when the player is standing.

The strap may include an adjustment mechanism operable to increase and/or decrease a length of at least one of the first and second legs such that an angle of the front plane with respect to true horizontal may be adjusted.

Other aspects, features, and advantages of the present invention will be apparent to one skilled in the art from the description herein taken in conjunction with the accompanying drawings.

DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF THE PREFERRED EMBODIMENTS

Figure 1B:
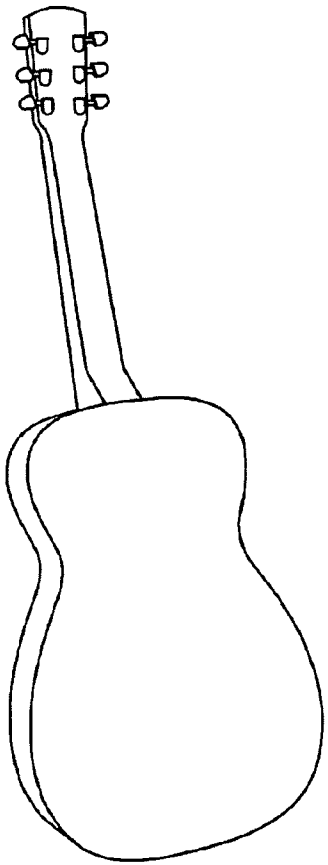
FIG. 1B (Prior Art)
FIGS. 1A and 1B are front and rear views of a lap steel guitar and a DoBro guitar, respectively, in accordance with the prior art.
Figure 1A:
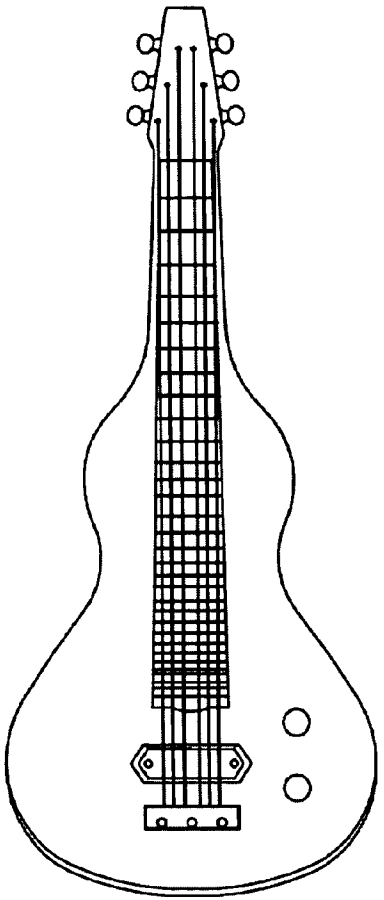
FIG. 1A (Prior Art)
Figure 2:
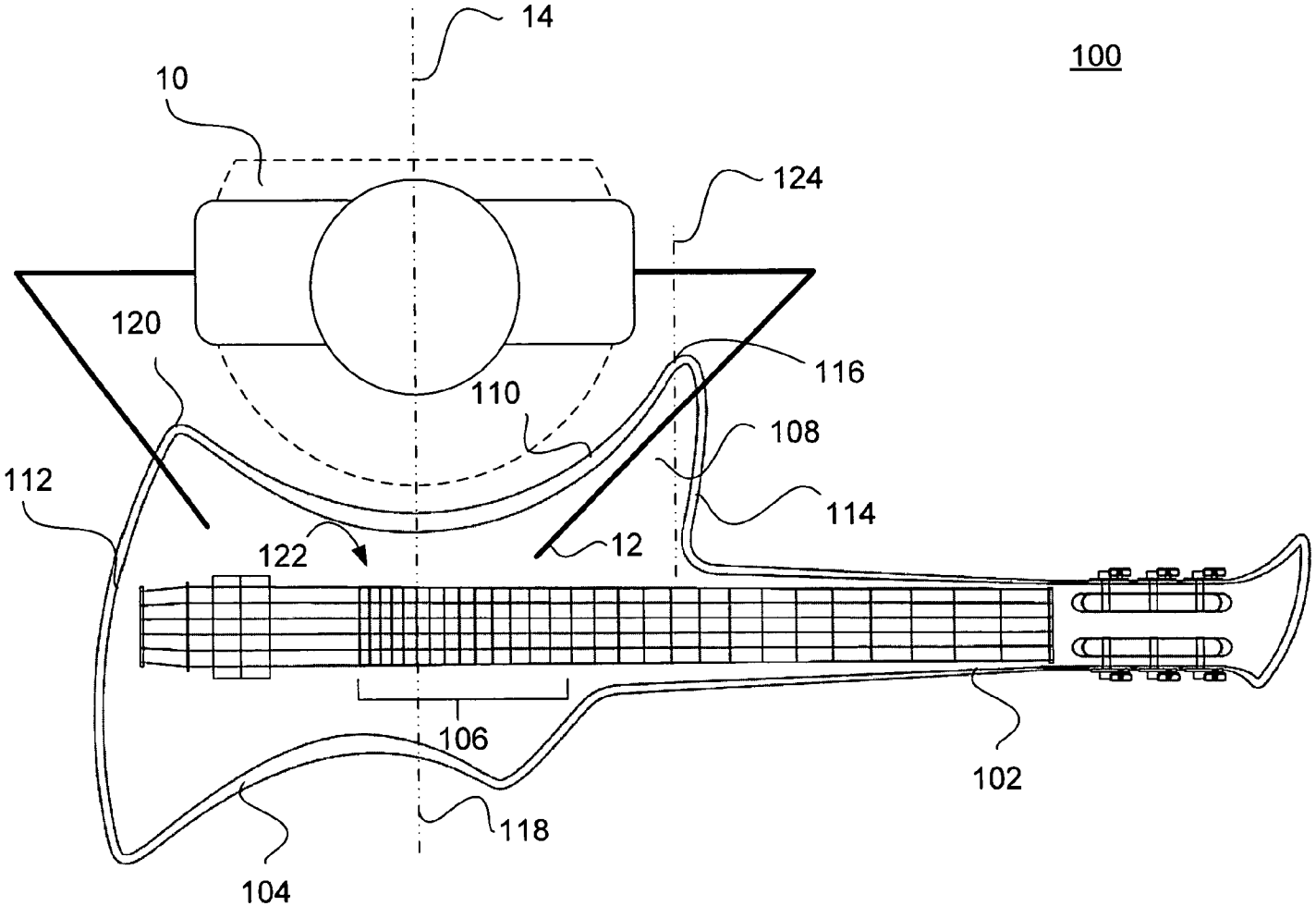
FIG. 2 is a front view of a guitar in accordance with one or more aspects of the present invention.

With reference to the drawings, wherein like numerals indicate like elements, there is shown in FIG. 2 a guitar 100 in accordance with one or more embodiments of the present invention. The guitar 100 is adapted to be suspended from a strap (not shown) about a player's shoulder or shoulders with a front plane of the guitar 100 oriented generally horizontally. Preferably, the guitar is a lap steel guitar, a slide guitar, an acoustic, or an electric guitar that has been adapted for horizontal playing.

The guitar 100 includes a neck 102, and a body 104 coupled to the neck 102. The features of the guitar 100 have been adapted to position the guitar 100 in an ergonomically advantageous way to maintain the orientation of the front plane of the guitar 100 (the plane of the illustrated page of FIG. 2) in a desirable, substantially horizontal, configuration with respect to the player 10 and to permit the fret-hand 12 ready access to higher frets 106 of the neck 102. The fret-hand 12 is the hand that moves the bar or slide (or presses the strings against the frets), which is often the left hand of right-handed players. In particular, the size and shape of the body 104 are such that the body 104 and neck 102 are offset towards the fret-hand 12 side of the player 10 when suspended from the strap (which will be discussed in more detail below).

It is noted that the frets 106 of the neck 102 may be actual elevated frets that may be engaged by pressing the strings, or, preferably, the frets are mere markings on the neck 102 to provide the player with an indication of where the slide or steel should be placed to achieve the desired effective length of the string.

The body 104 includes a horn 108 extending from the body 104 transversely with respect to the neck 102. The horn 108 includes a curvate edge 110 (e.g., a concave edge) that engages a midsection (gut area) of the player 10 in a way that offsets the body 104 and neck 102 towards the fret-hand 12 side of the player 10. The curvate edge 110 extends from the horn to a bottom edge 112 of the body 104. More particularly, the horn 108 includes a leading edge 114 that extends transversely from the body 104 on a first side of the neck 102 and terminates at a tip 116. The curvate edge 110 extends from the tip 116 toward the bottom of the body 104 and engages a substantial portion of the player's midsection to offset the guitar 100.

The horn 108 extends a sufficient distance from the body 104 to support the curvate edge 110 such that the player 10 has ready access to higher frets 106 of the neck 102. For example, the tip 116 of the horn 108 may extend transversely from the body 104 on the one side of the neck 102 a distance farther than any other portion of the body 104 on that side of the neck 102. Indeed, it can be seen in FIG. 2 that the tip 116 extends beyond a minor tip 120 of the body 104 near the bottom edge 112. Additionally or alternatively, the horn 108 may be sized and shaped such that the tip 116 thereof faces in a direction substantially perpendicular to the neck 102.

Preferably, there is substantial engagement of the curvate edge 110 and the player's midsection in order to ensure desirable offset of the guitar 100 towards the fret-hand 12 of the player 10. For example, in one or more embodiments, the curvate edge 110 is sized and shaped to engage the player's midsection starting from the fret-hand side of the midsection and extending past a center line 14 of the player 10. Additionally or alternatively, the horn 108 and curvate edge 110 are sized and shaped such that the body 104 is offset towards the fret-hand side of the player 10 in such a manner that the center line 14 of the player 10 is positioned substantially axially aligned with a horizontal bisecting axis 118 of the body 104 of the guitar 100. Further additions and/or alternatives include that the curvate edge 110 of the horn 108 is sized and shaped such that the body 104 and neck 102 are offset towards the fret-hand side of the player 10 such that the center line 14 of the player 10 is positioned substantially perpendicular to an end 122 of a fret-board of the neck 102. Still further additions and/or alternatives include that the curvate edge 110 of the horn 108 is sized and shaped such that a center line 124 of the horn, between the leading and curvate edges, 114, 110, is positioned substantially adjacent to frets 6-12 of the neck 102, such as adjacent to frets 8-10 of the neck 102.

The features of the curvate edge 110 of the guitar body 104 discussed above may stand alone or be combined with one or more further features of the present invention. The guitar 100 preferably includes a strap 200 (shown schematically in FIG. 3 and in more detail in FIGS. 4-5) The strap 200 is operable to extend over the player's shoulder or shoulders such that the front plane of the guitar 100 is oriented generally horizontally when the player 10 is standing. The strap 200 is designed for a three-point connection to the guitar 100. In this regard, the strap 100 includes a central section (a shoulder strap portion) 202 sized, shaped, and positioned to engage the player's shoulder or shoulders; and first and second ends 204, 206 coupled from the central section 202 to the guitar 100. More particularly, the second end 206 includes first and second legs 206A, 206B extending from an origin 208 and terminating at the guitar 100.

The guitar 100 includes at least three strap buttons 210, 212, 214 disposed about the neck 102 and the body 104, and the strap 200 is coupled to the strap buttons 210, 212, 214 such that the guitar 100 is suspended from the strap 200 at three points. The first strap button 210 is located near an end of the neck 102 opposite the body 104, and the second and third strap buttons 212, 214 are spaced apart from one another at the bottom edge 112 of the body 104. The first end 204 of the strap 200 is coupled from the central section 202 to the first strap button 210 of the neck 102. The first and second legs 206A, 206B of the strap 200 extending from the origin 208 and terminate at the second and third strap buttons, 212, 214, respectively.

Figure 5:
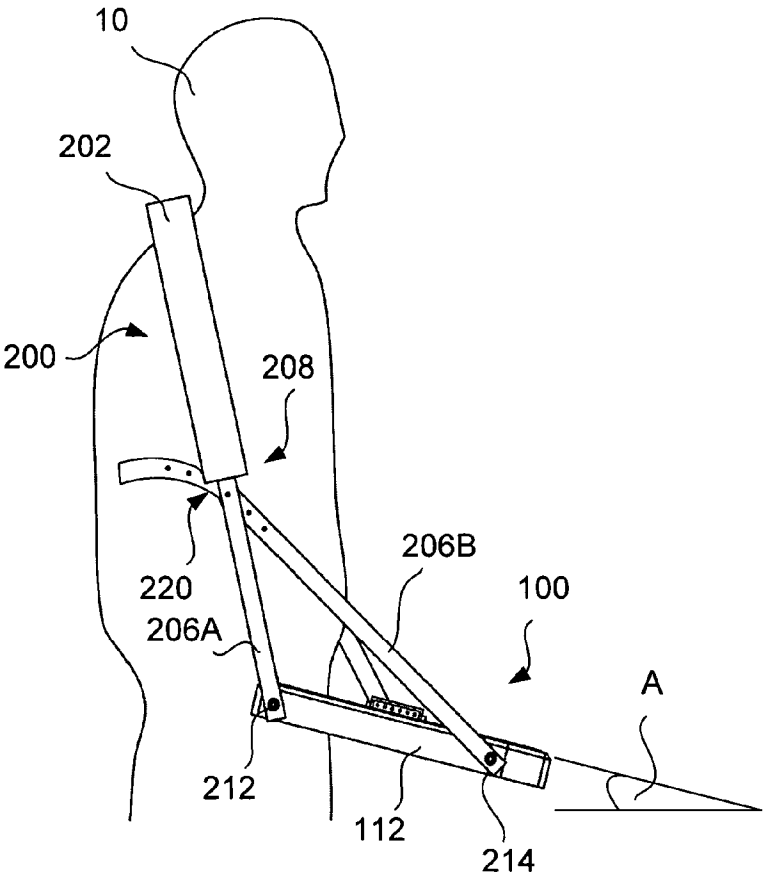
FIGS. 4-5 are side views of the guitar of FIG. 1 and more detailed illustrations of the strap in accordance with one or more further aspects of the present invention.
Figure 4:
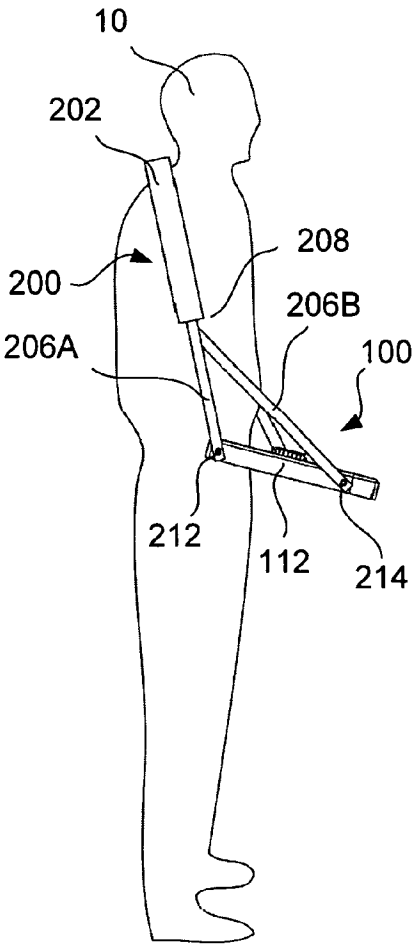

As the second and third strap buttons 212, 214 are spaced apart from one another at the bottom edge 112 of the body 104 and the strap 200 includes a Y-shaped terminal end 206, the first and second legs 206A, 206B of the strap cooperate to maintain the orientation of the front plane of the guitar 100 when the player 10 is standing. As illustrated in FIGS. 4 and 5, one such orientation is substantially horizontal to the ground on which the player 10 is standing. The orientation, however, may be adjusted without departing from the scope of the instant invention. The strap 200 may include an adjustment mechanism 220 operable to increase and/or decrease a length of at least one of the first and second legs 206A, 206B (preferably the second leg 206B) such that an angle A (see FIG. 5) of the front plane with respect to true horizontal may be adjusted. By way of example, the adjustment mechanism 220 may include suitable fasteners that change the length between the origin 208 and the terminal end of the second leg 206B. The fasteners may include buttons/holes, hooks/eyes, belt buckle(s), Velcro™, etc.

Figure 3:
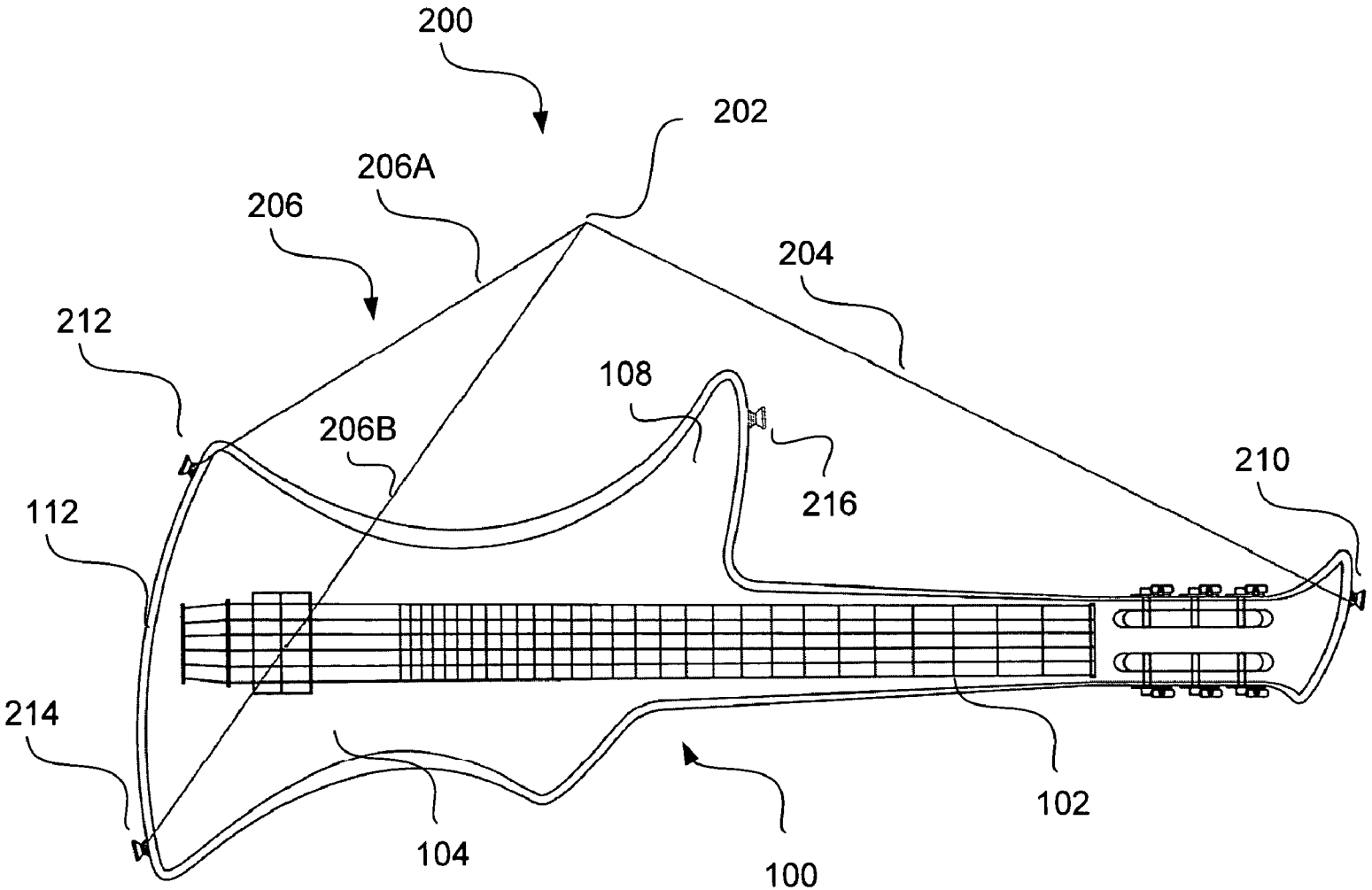
FIG. 3 is a front view of the guitar of FIG. 1 including a schematic view of a strap in accordance with one or more aspects of the present invention.
Figure 6B:
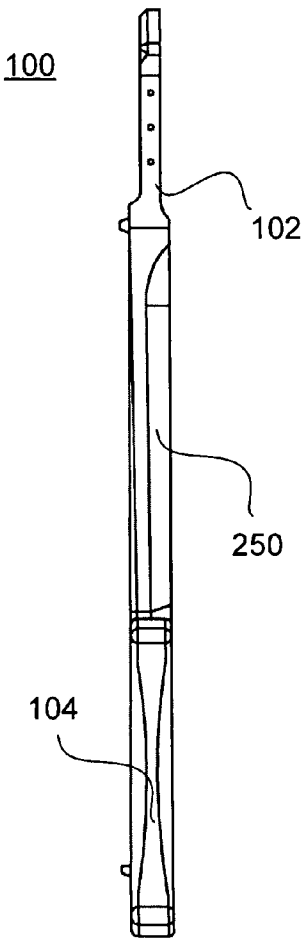
FIGS. 6A-6B are rear and side views, respectively, of an optional chamfer feature on the neck of the guitar of FIG. 2.
Figure 6A:
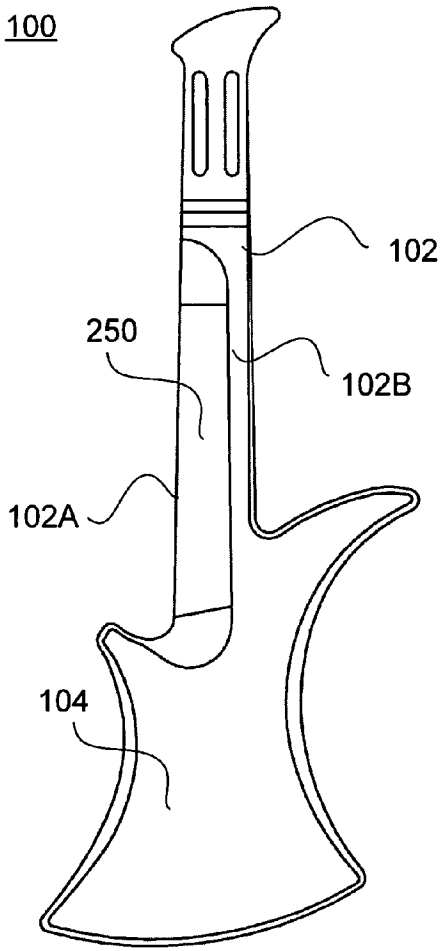

With reference to FIGS. 3 and 6A, 6B, in one or more alternative embodiments, the guitar 100 may include a strap button 216 on the leading edge 114 of the horn 108 (see FIG. 3). The additional strap button 216 permits the guitar 100 to be suspended from a convention two-point strap in the vertical orientation. For example, the conventional two-point strap may be coupled from strap button 216 to either of the butt-end strap buttons 212, 214.

As shown in FIGS. 6A, 6B, the neck 102 of the guitar 100 may be of substantially square cross-section and alternatively or additionally include a chamfer 250 on the backside of the neck 102 (opposite to the fret board). The chamfer 250 provides relief for the user's hand when playing the guitar 100 in the vertical orientation. The chamfer 250 extends the length of the neck 102 and may be in a sloped configuration, sloping from the edge 102A (at which the neck 102 is of minimum thickness) to a maximum thickness at 102B.

Advantageously, the features of the present invention address the shortcomings of convention guitar design and strap design such that a guitar may be suspended from the strap with a front plane of the guitar oriented generally horizontally and with the higher frets of the guitar easily accessed by the player's fret-hand.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A guitar adapted to be suspended from a strap about a player's shoulder with a front plane of the guitar oriented generally horizontally, comprising:

a neck;

a body coupled to the neck; and a horn extending from the body transversely with respect to the neck to a tip of the horn, the horn including a curvate edge extending from the tip toward a bottom of the body for engaging a fret-hand side of the player, wherein the tip and curvate edge of the horn extend a sufficient distance from the body such that the body and neck are offset towards the fret-hand side of the player when suspended, thereby giving the player ready access to higher frets of the neck.

2. The guitar of claim 1, wherein the curvate edge is sized and shaped to engage the player's midsection starting from the fret-hand side thereof and extending past a center thereof.

3. The guitar of claim 1, wherein the horn is sized and shaped such that the body and neck are offset towards the fret-hand side of the player such that a center of the player is positioned substantially perpendicular to an end of a fret-board of the neck.

4. The guitar of claim 1, wherein the horn is sized and shaped such that the body is offset towards the fret-hand side of the player such that a center of the player is positioned substantially axially aligned with a horizontal bisecting axis of the body.

5. The guitar of claim 1, wherein the tip of the horn extends transversely from the body on a first side of the neck a distance from the neck farther than any other portion of the body on the first side of the neck.

6. The guitar of claim 5, wherein:

the horn is defined by a leading edge extending substantially transversely from the body and terminating at the tip, and the curvate edge extending from the tip toward the bottom of the body; and the tip of the horn faces in a direction substantially perpendicular to the neck.

7. The guitar of claim 1, wherein:

the horn is defined by a leading edge extending substantially transversely from the body and terminating at the tip, and the curvate edge extending from the tip toward the bottom of the body; and a center line of the horn, between the leading and curvate edges, is positioned substantially adjacent to frets 6-12 of the neck.

8. The guitar of claim 7, wherein the center line of the horn is positioned substantially adjacent to frets 8-10 of the neck.

9. The guitar of claim 1, further comprising at least three strap buttons disposed about the neck and body.

10. The guitar of claim 9, further comprising a strap coupled to the strap buttons such that the guitar is suspended from the strap at three points.

11. The guitar of claim 1, further comprising: at least four strap buttons disposed about the neck and body, a first of the strap buttons being located near an end of the neck opposite the body, second and third strap buttons being spaced apart from one another at a bottom edge of the body, and a fourth strap button being located on the horn.

12. The guitar of claim 11, wherein the first, second and third strap buttons are positioned such that a three-point strap may be coupled thereto and the guitar may be suspended from the strap at three points in a horizontal orientation.

13. The guitar of claim 11, wherein the fourth and one of the second and third strap buttons are positioned such that a two-point strap may be coupled thereto and the guitar may be suspended from the strap at two points in a vertical orientation.

14. The guitar of claim 1, wherein:

the neck includes a fret board on one side thereof; and the neck is of substantially square cross-section and includes a chamfer on a side thereof opposite to the fret board, the chamfer providing a varying thickness to the neck starting from one edge and sloping to a position of maximum thickness.

15. The guitar of claim 1, further comprising:

at least three strap buttons disposed about the neck and body; and a strap coupled to the strap buttons such that the guitar is suspended from the strap at three points.

16. The guitar of claim 15, wherein a first of the strap buttons is located near an end of the neck opposite the body, and second and third strap buttons are spaced apart from one another at a bottom edge of the body.

17. The guitar of claim 15, wherein the strap is operable to extend over a player's shoulder such that a front plane of the guitar is oriented generally horizontally when the player is standing.

18. The guitar of claim 15, wherein the strap includes:

a central section disposed to engage the player's shoulder or shoulders;

a first end coupled from the central section to a first of the three strap buttons located on the neck; and a second end coupled from the central section to second and third strap buttons located on the body.

19. The guitar of claim 18, wherein the second end of the strap includes first and second legs extending from an origin and terminating at the second and third strap buttons, respectively.

20. The guitar of claim 19, wherein the second and third strap buttons are spaced apart from one another at a bottom edge of the body such that the first and second legs cooperate to maintain an orientation of a front plane of the guitar when the player is standing.

21. The guitar of claim 20, further comprising an adjustment mechanism operable to increase and/or decrease a length of at least one of the first and second legs such that an angel of the front plane with respect to true horizontal may be adjusted.

22. A guitar, comprising:

a neck;

a body coupled to the neck; and a horn extending from the body transversely from a first side of the neck to a tip, the horn including a curvate edge extending from the tip toward a bottom of the body, the tip extending a distance from the body farther than any other portion of the body on the first side of the neck, wherein at least one of:

the curvate edge is sized and shaped to engage the player's midsection starting from the fret-hand side thereof and extending past a center thereof;

the horn is sized and shaped such that the body and neck are offset towards the fret-hand side of the player such that a center of the player is positioned substantially perpendicular to an end of a fret-board of the neck;

the horn is sized and shaped such that the body is offset towards the fret-hand side of the player such that a center of the player is positioned substantially axially aligned with a horizontal bisecting axis of the body;

the tip of the horn faces in a direction substantially perpendicular to the neck;

a center line of the horn, between the leading and curvate edges, is positioned substantially adjacent to frets 6-12 of the neck; and the center line of the horn is positioned substantially adjacent to frets 8-10 of the neck.

23. The guitar of claim 22, wherein:

the neck includes a fret board on one side thereof; and the neck is of substantially square cross-section and includes a chamfer on a side thereof opposite to the fret board, the chamfer providing a varying thickness to the neck starting from one edge and sloping to a position of maximum thickness.

* * * * *